US008937625B2

(12) United States Patent
Lee

(10) Patent No.: US 8,937,625 B2
(45) Date of Patent: Jan. 20, 2015

(54) FABRIC DRYER AND METHOD OF CONTROLLING THE SAME

(71) Applicant: LG Electronics Inc., Seoul (KR)

(72) Inventor: Deughee Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 138 days.

(21) Appl. No.: 13/659,039

(22) Filed: Oct. 24, 2012

(65) Prior Publication Data

US 2013/0139403 A1 Jun. 6, 2013

(30) Foreign Application Priority Data

Oct. 24, 2011 (KR) ..... 10-2011-0108754

(51) Int. Cl.
*F26B 25/06* (2006.01)
*D06F 58/28* (2006.01)
*D06F 58/20* (2006.01)

(52) U.S. Cl.
CPC ..... *F26B 25/06* (2013.01); *D06F 58/28* (2013.01); *D06F 58/203* (2013.01); *D06F 2058/2803* (2013.01); *D06F 2058/2877* (2013.01); *D06F 2058/2883* (2013.01)
USPC ..... 345/595; 34/381; 34/606; 34/610; 68/20; 8/115.51; 510/276

(58) Field of Classification Search
USPC ..... 34/595, 380, 381, 601, 606, 610; 68/19, 68/20; 8/115.51, 137, 149, 159; 134/42; 510/276, 285, 379
See application file for complete search history.

(56) References Cited

U.S. PATENT DOCUMENTS

| | | | | |
|---|---|---|---|---|
| 3,521,638 | A * | 7/1970 | Parrish | 604/364 |
| 4,781,041 | A * | 11/1988 | Fowler | 68/18 F |
| 5,667,683 | A * | 9/1997 | Benian | 210/409 |
| 5,780,407 | A * | 7/1998 | Van Slyke | 510/188 |
| 6,172,031 | B1 * | 1/2001 | Stevens | 510/417 |

(Continued)

FOREIGN PATENT DOCUMENTS

| | | | |
|---|---|---|---|
| CN | 1614118 | A | 5/2005 |
| CN | 101302697 | A | 11/2008 |

(Continued)

OTHER PUBLICATIONS

Korean Notice of Allowance dated Nov. 26, 2013 issued in Application No. 10-2011-0108754.

(Continued)

*Primary Examiner* — Steve M Gravini
(74) *Attorney, Agent, or Firm* — Ked & Associates, LLP

(57) ABSTRACT

Provided are a fabric dryer and a method of controlling the fabric dryer. The fabric dryer includes a drum, a driving unit, a steam supply unit, a radical supply unit, a contamination removal function selector, and a controller. The drum is rotatably disposed and receives laundry. The driver rotates the drum. The steam supply unit supplies steam into the drum. The radical supply unit supplies radical into the drum. The contamination removal function selector selects a water-soluble contaminant or a fat-soluble contaminant. The controller controls the steam supply unit to supply steam in response to selection of the water-soluble-contaminant by the contamination removal function selector, and controls the radical supply unit to supply radical in response to selection of fat-soluble contaminant by the contamination removal function selector.

16 Claims, 6 Drawing Sheets

(56) References Cited

U.S. PATENT DOCUMENTS

| | | | | |
|---|---|---|---|---|
| 7,297,277 | B2 * | 11/2007 | Radomyselski et al. | 210/644 |
| 7,497,877 | B2 * | 3/2009 | Goedhart et al. | 8/137 |
| 8,545,574 | B2 * | 10/2013 | Vinson et al. | 8/115.51 |
| 2004/0117920 | A1 * | 6/2004 | Fyvie et al. | 8/158 |
| 2005/0126606 | A1 * | 6/2005 | Goedhart et al. | 134/42 |
| 2005/0209469 | A1 * | 9/2005 | Shutt et al. | 549/523 |
| 2005/0223500 | A1 * | 10/2005 | Haught et al. | 8/115.51 |
| 2006/0169624 | A1 * | 8/2006 | Radomyselski et al. | 210/96.1 |
| 2007/0099809 | A1 * | 5/2007 | Radomyselski et al. | 510/285 |
| 2009/0062581 | A1 * | 3/2009 | Appel et al. | 585/241 |
| 2009/0148342 | A1 * | 6/2009 | Bromberg et al. | 422/37 |
| 2009/0238811 | A1 * | 9/2009 | McDaniel et al. | 424/94.2 |
| 2010/0077691 | A1 * | 4/2010 | Constantz et al. | 52/596 |
| 2010/0150802 | A1 * | 6/2010 | Gilliam et al. | 423/220 |
| 2013/0139403 | A1 * | 6/2013 | Lee | 34/487 |
| 2014/0075683 | A1 * | 3/2014 | Kim et al. | 8/137 |

FOREIGN PATENT DOCUMENTS

| | | | | |
|---|---|---|---|---|
| DE | 102012219418 | | * | 4/2013 |
| GB | 1493972 | A | * | 12/1977 |
| KR | 10-0672349 | B1 | | 1/2007 |
| KR | 10-0825951 | B1 | | 4/2008 |
| KR | 10-2008-0073453 | A | | 8/2008 |
| KR | 101053626 | | * | 8/2011 |

OTHER PUBLICATIONS

Chinese Office Action dated Jul. 2, 2014, issued in Application No. 201210408499.0.

* cited by examiner

FABRIC DRYER AND METHOD OF CONTROLLING THE SAME

This application claims priority to Korean Patent application no. 10-2011-0108754 filed Oct. 24, 2011, which is hereby incorporated by reference.

BACKGROUND OF THE INVENTION

1. Field of the Invention

The present invention relates to a fabric dryer and a method of controlling the fabric dryer.

2. Description of the Related Art

Generally, a fabric dryer is an apparatus that dries wet clothes, bedclothes, etc. (hereinafter, referred to as 'laundry'). The fabric dryer includes a drum receiving laundry and a motor for driving the drum, and a heater for supplying hot air into the drum. The fabric dryer supplies dry hot air heated by the heater into the drum holding laundry and rotates the drum to dry laundry.

Since a typical fabric dryer is configured to dry only wet laundry, when spots or other contaminants are found in wet laundry to be dried, a washing machine needs to be separately driven to remove the spots and the contaminants. Also, when the quantity of laundry having spots or other contaminants is small, it is inefficient to separately drive the washing machine to remove the spots or other contaminants in terms of time and cost.

SUMMARY OF THE INVENTION

Thus, an object of the present invention is to provide a fabric dryer and a method of controlling the fabric dryer, which can remove contaminants from laundry without operating a separate washing machine.

According to an aspect of the present invention, there is provided a fabric dryer including: a drum rotatably disposed and receiving laundry; a driving unit rotating the drum; a steam supply unit supplying steam into the drum; a radical supply unit for supplying radical into the drum; a contamination removal function selector for selecting a water-soluble contaminant or a fat-soluble contaminant; and a controller configured to control the steam supply unit to supply steam in response to selection of the water-soluble-contaminant by the contamination removal function selector, and control the radical supply unit to supply radical in response to selection of fat-soluble contaminant by the contamination removal function selector.

According to another aspect of the present invention, there is provided a method of controlling a fabric dryer, including: selecting a water-soluble contaminant or a fat-soluble contaminant through a contamination removal function selector; and removing the contaminant from laundry in a drum according to the selected contaminant, wherein steam is supplied into the drum when the selected contaminant is water-soluble, and radical is supplied into the drum when the selected contaminant is fat-soluble.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
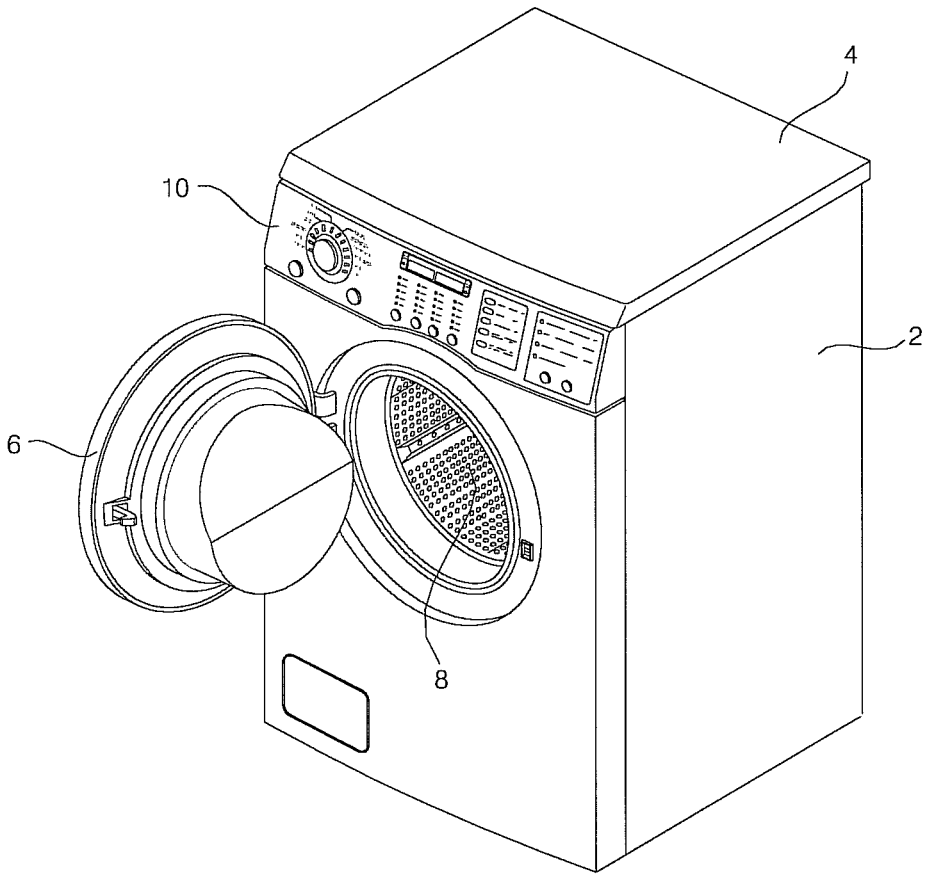
FIG. 1 is a perspective view illustrating a fabric dryer according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Hereinafter, exemplary embodiments of a fabric dryer according will be described in detail with reference to the accompanying drawings.

Figure 2:
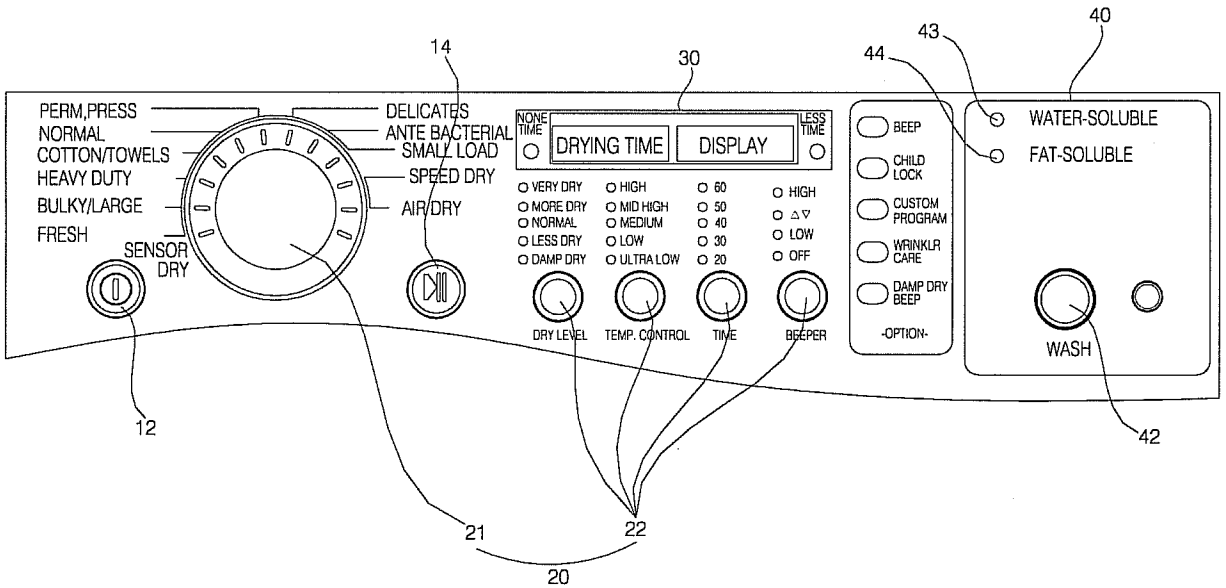
FIG. 2 is a view illustrating a control panel of FIG. 1.
Figure 3:
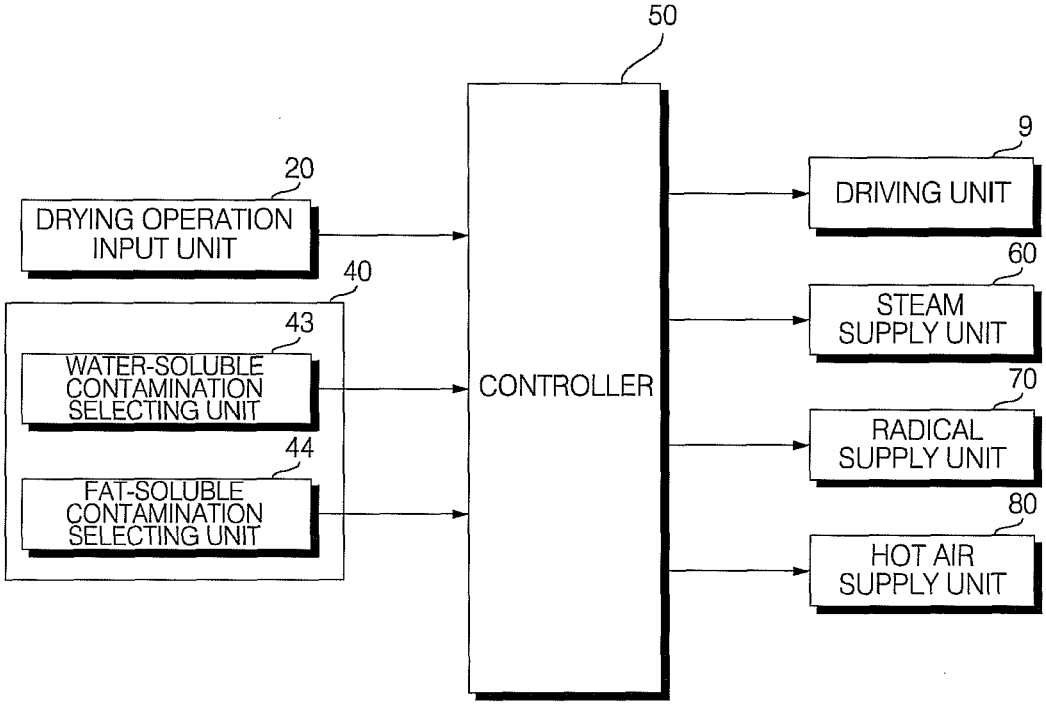
FIG. 3 is a view illustrating a main configuration of a fabric dryer according to an embodiment of the present invention.

FIG. 1 is a perspective view illustrating a fabric dryer according to an embodiment of the present invention. FIG. 2 is a view illustrating a control panel of FIG. 1. FIG. 3 is a view illustrating a main configuration of a fabric dryer according to an embodiment of the present invention.

Referring to FIG. 1, the fabric dryer may include a cabinet 2 defining the exterior, a top cover 4 for covering the upper side of the cabinet 2, and a control panel 10 disposed at a front upper side of the cabinet 2.

A drum 8 may be rotatably disposed in the cabinet 2 to hold laundry. Also, a motor (not shown) for driving the drum 8 and a hot air supply unit 80 for supplying hot air or cool air into the drum 8 may be disposed in the cabinet 2.

The hot air supply unit 80 may include a heater (not shown) and a blowing fan (not shown) for blowing air heated by the heater into the drum 8.

A steam supply unit 60 may be disposed in the cabinet 2 to supply steam into the drum 8. The steam supply unit 60 may supply steam generated by heating water into the drum 8.

Also, a radical supply unit 70 may be disposed in the cabinet 2 to generate radical into the drum 8. The radical supply unit 70 may include an air pumping unit (not shown), an ozone generating unit (not shown), and a molecular conversion unit (not shown). The air pumping unit (not shown) may supply air for generating ozone to the ozone generating unit, and the ozone generating unit (not shown) may generate ozone by applying a high voltage to supplied air or irradiating ultraviolet rays. The molecular conversion unit may react supplied ozone with a radical conversion catalyst to generate OH radical. The generated radical can sterilize bacteria or virus living in water or clothes through a strong and rapid oxidation process.

Referring to FIG. 2, the control panel 10 may include a plurality of drying operation input unit 20 manipulated to select a dry operation condition and a contamination removal function selecting unit 40 for removing predetermined contaminants.

The plurality of drying operation input unit 20 may include a course selection dial 21 for selecting drying courses that are programmed and a plurality of selection buttons 22 for selecting detail drying operation condition other than the drying course. The plurality of selection buttons 22 may include a dry level button for selecting the degree of the drying, a temperature control button for selecting the temperature of hot air supplied upon drying, a drying time selection button for selecting the drying time, and a beep sound selection button for selecting a beep alarming a user.

Also, the control panel 10 may include a power button 12 and a pause button 14 for resuming the operation of each course or pausing the operation of each course Also, the control panel 10 may include a display unit 30 for displaying the input conditions or the operation state of the fabric dryer.

The contamination removal function selecting unit 40 may be disposed at one side of the control panel 10 separately from the drying operation input unit 20. The contamination removal function selecting unit 40 may include a plurality of contamination selecting units 43 and 44 such that a user can select one from predetermined contaminants. In this embodiment, the predetermined contaminants may include water-soluble contaminants, fat-soluble contaminants such as sebum, liquid contaminants, solid contaminants such as dust and soil.

The contamination removal function selecting unit 40 may be configured to select one from the plurality of contamination selecting units 43 and 44 according to the push number of one pushable button or the rotation angle of a rotatable dial. Alternatively, the plurality of contamination selection units 43 and 44 may include a corresponding button, respectively. When buttons are provided to the plurality of contamination selecting units 43 and 44, respectively, two or more buttons can be selected.

The contamination removal function selecting unit 40 may include a contamination removal function selecting button 42 that is a push-type button. The plurality of contamination selecting units 43 and 44 may be selected according to the push number of the contamination removal function selecting button 42. For example, when the contamination removal function selecting unit 40 is pushed once, the water-soluble contamination selecting unit 43 may be selected, and when the contamination removal function selecting unit 40 is pushed twice, the fat-soluble contamination selecting unit 44 may be selected.

Referring to FIGS. 2 and 3, the plurality of contamination selecting units 43 and 44 may include the water-soluble contamination selecting unit 43 for removing water-soluble contaminants and the fat-soluble contamination selecting unit 44 for removing fat-soluble contaminants. In this embodiment, the plurality of contamination selecting units 43 and 44 are described as being divided into two kinds, but embodiments are not limited thereto. For example, the plurality of contamination selecting units may be divided into more kinds according to the kinds of contaminants, and may also be configured to select a combination of two or more contaminants.

The plurality of contamination selecting units may include entries corresponding to each contaminant and indicating lamps for indicating whether or the entries are selected. For example, when the contamination removal function selecting button 42 is pushed once, the water-soluble contamination selecting unit 43 may be selected and the indicating lamp corresponding to the water-soluble contamination selecting unit 43 may be lighted. Referring to FIG. 2, although in the control panel 10, the plurality of contamination selecting units are written in English, embodiments are not limited thereto. For example, the plurality of contamination selecting units may be written in other languages or symbols.

The fabric dryer may include a controller 50 for controlling the operation of the fabric dryer according to signals inputted into the control panel 10.

When the drying operation input unit 20 and the contamination removal function selecting unit 40 are both selected, the controller 50 may control to perform the drying operation after a contamination removing course for removing contaminants.

The controller 50 may control the operation of the driving unit 9, the steam supply unit 60 and the radical supply unit 70 according to signals inputted into the drying operation input unit 20 and the contamination removal function selecting unit 40.

When the water-soluble contamination selecting unit 43 is selected, the controller 50 may control the operation of the steam supply unit 60 to supply steam to laundry in the drum 8.

When the fat-soluble contamination selecting unit 44 is selected, the controller 50 may control the operation of the radical supply unit 70 to supply radical to laundry in the drum 8.

Figure 4:
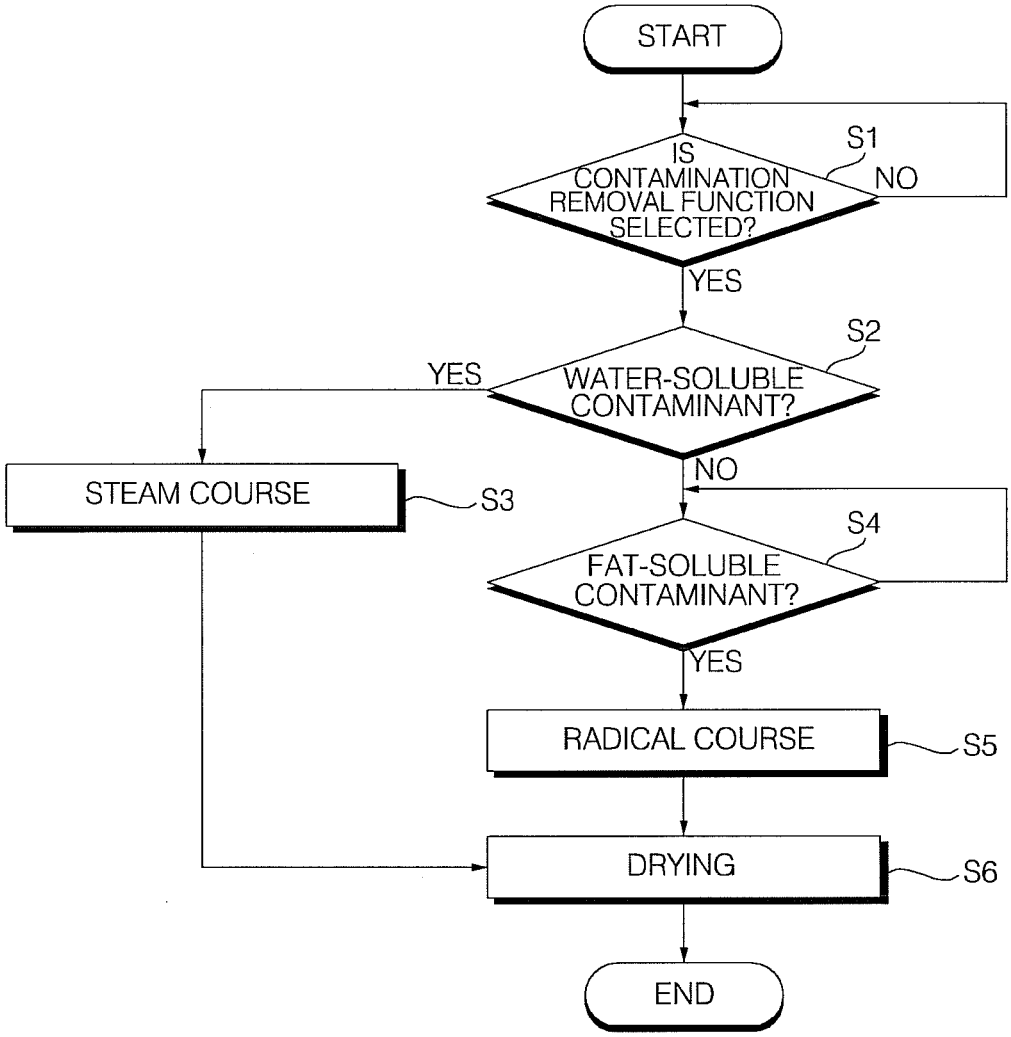
FIG. 4 is a flowchart illustrating a method of controlling a fabric dryer according to an embodiment of the present invention.

FIG. 4 is a flowchart illustrating a method of controlling a fabric dryer according to an embodiment of the present invention. Hereinafter, the operation of the fabric dryer will be described with reference to FIG. 4.

When a user intends to use the fabric dryer, the user may push the power button 12, and then input a desired drying course using the course selecting dial 21, or may input a desired drying operation condition using the plurality of selection buttons 22.

When power is applied through the power button 12, the controller 50 may check whether the contamination removal function is selected (S1).

When a user finds contaminants from laundry during the drying of laundry or intends to remove contaminants of laundry using a fabric dryer instead of a separate washing machine, the user may use the contamination removal function of the fabric dryer.

When a user intends to use the contamination removal function of the fabric dryer, the user may manipulates the contamination removal function selecting button 42. As described above, since the contamination removal function selecting button 42 is a push-type button, a user may push the contamination removal function selecting button 42.

When a user pushes the contamination removal function selecting button 42, a push signal may be inputted into the controller 50. Then, the controller 50 may determine that the contamination removal function has been selected.

When the controller 50 determines that the contamination removal function has been selected, the controller 50 may determine whether or not the kind of contaminants is selected (S2 and S4). That is, after the contamination removal function selecting butting 42 is pushed, the controller 50 may wait such that the kind of contaminant can be selected within a predetermined duration.

When the controller 50 determines that the water-soluble contamination selecting unit 43 has been selected (S2), the controller 50 may operate the steam supply unit 60 to supply steam to laundry in the drum 8. As described above, while steam is being supplied to laundry in the drum 8, the controller 50 may control the operation of the driving unit 9 to rotate the drum 8. Also, the controller 50 may operate the hot air supply unit 80 to increase the temperature of laundry wetted by steam. As the temperature of wet laundry increases, the degradation of contaminants by water may be facilitated. Particularly, a user can process laundry with detergent, and then load laundry into the drum 8. In this case, the activity of detergent can be improved through the hot air supply process, and thus the washing performance can be improved.

When the controller 50 determines that the fat-soluble contamination selecting unit 44 has been selected (S4), the controller 50 may operate the radical supply unit 70 to supply radical to laundry in the drum 8 (S5). Since fat-soluble contaminants such as sebum are difficult to remove, radical having good washing efficiency may be used to remove the contaminants. As described above, while radical is being supplied to laundry in the drum 8, the controller 50 may control the operation of the driving unit 9 to rotate the drum 8.

After the contamination removing course is completed, the controller 50 may perform a drying cycle according to conditions preset through the control panel 10 (S6).

In this embodiment, since contaminants can be removed from the fabric dryer without operating a separate washing machine, convenience for use can be improved.

Figure 5:
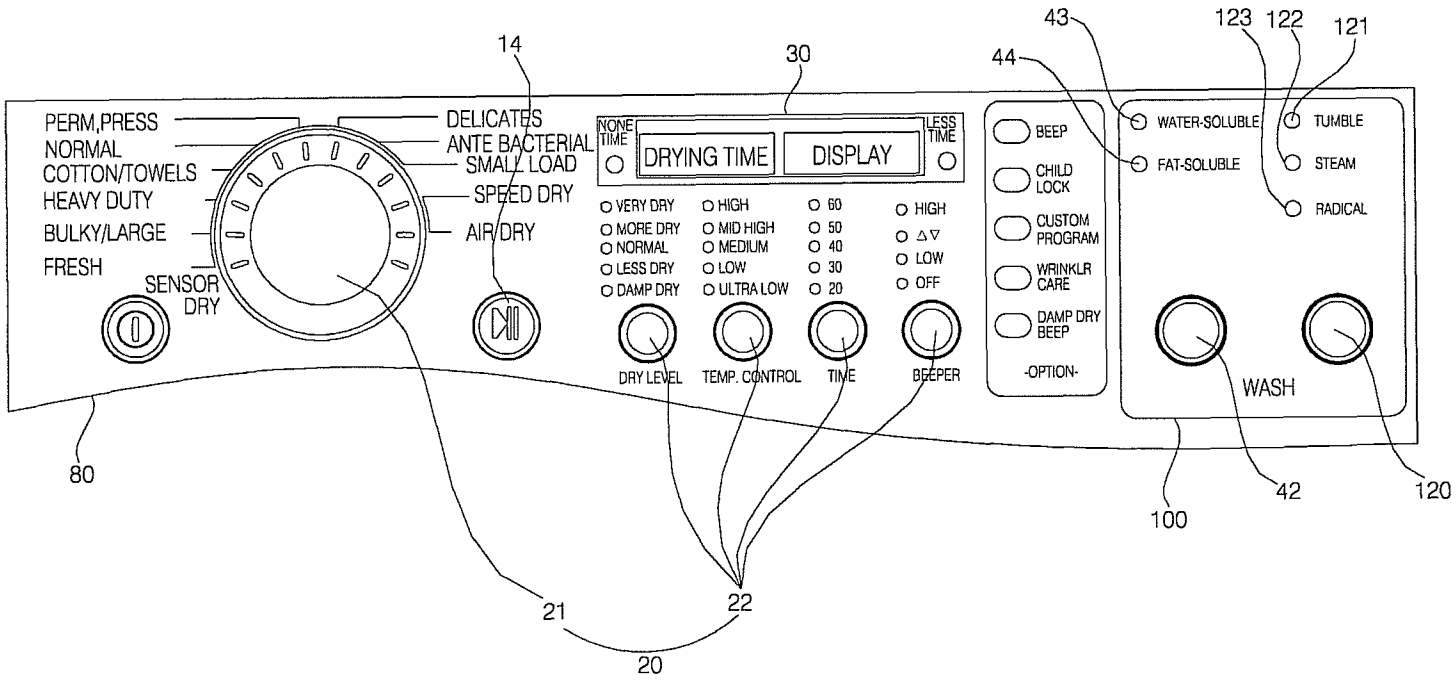
FIG. 5 is a view illustrating a control panel according to another embodiment of the present invention.
Figure 6:
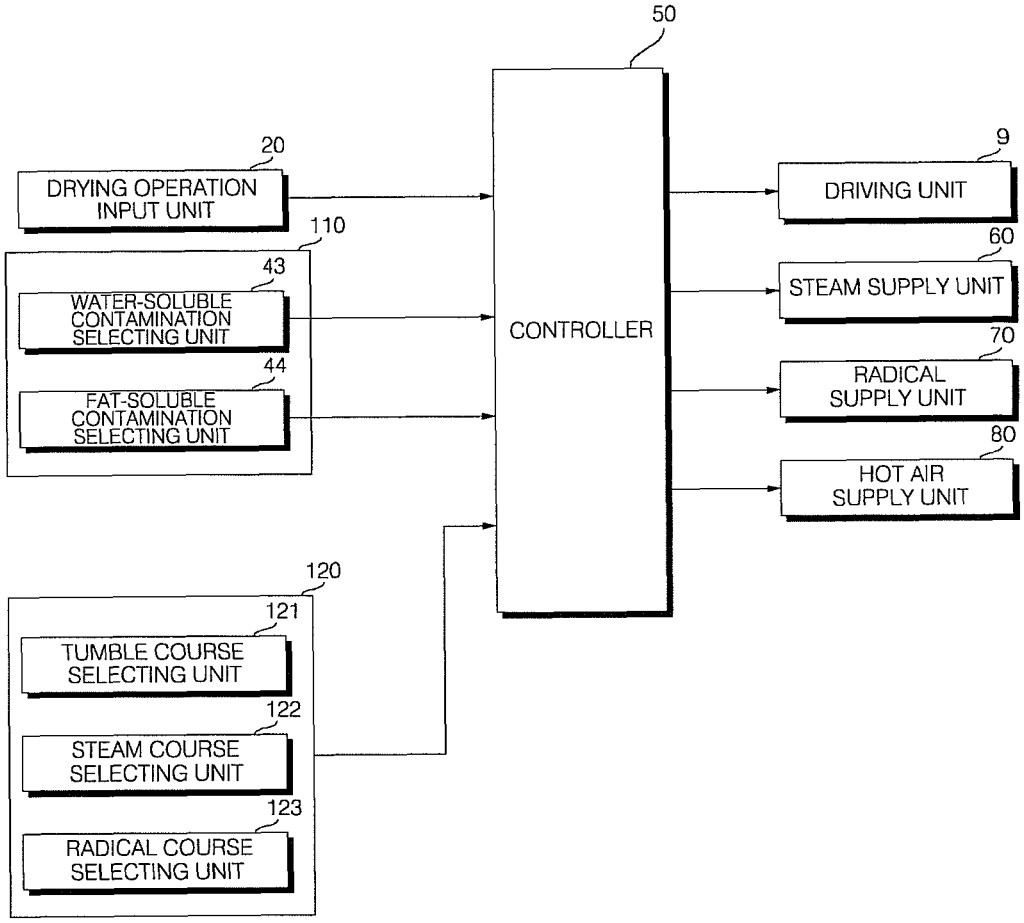
FIG. 6 is a view illustrating a main configuration of a fabric dryer according to another embodiment of the present invention.

FIG. 5 is a view illustrating a control panel according to another embodiment of the present invention. FIG. 6 is a view illustrating a main configuration of a fabric dryer according to another embodiment of the present invention.

Referring to FIGS. 5 and 6, a control panel 80 according to this embodiment may differ from the control panel 10 according to the previous embodiment in that the control panel 80 includes a plurality of course selecting units 121, 122 and 123, but other configurations and operations are similar to those of the previous embodiment, and thus a detail description thereof will be omitted below.

The plurality of course selecting units 121, 122 and 123 may include a tumble course selecting unit 121 for tumbling laundry in a drum 8 by driving a driving unit 9, a steam course selecting unit 122 for generating steam into the drum 8 by operating a steam supply unit 60, and a radical course selecting unit 123 for generating radical into the drum 8.

When one of the plurality of course selecting units 121, 122 and 123 is selected, the selected contamination removing course may proceed.

When the tumble course selecting unit 121 is selected, a controller 50 may control the operation of the driving unit 9 to tumble laundry in the drum 8.

When the steam course selecting unit 122 is selected, the controller 50 may control the operation of the steam supply unit 60 to supply steam to laundry in the drum 8.

When the radical course selecting unit 123 is selected, the controller 50 may control the operation of a radical supply unit 70 to supply radical to laundry in the drum 8.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A fabric dryer comprising:

a drum rotatably disposed and receiving laundry;

a driving unit rotating the drum;

a steam supply unit supplying steam into the drum;

a radical supply unit for supplying radical into the drum;

a contamination removal function selector for selecting a water-soluble contaminant or a fat-soluble contaminant; and a controller configured to control the steam supply unit to supply steam in response to selection of the water-soluble-contaminant by the contamination removal function selector, and control the radical supply unit to supply radical in response to selection of fat-soluble contaminant by the contamination removal function selector.

2. The fabric dryer of claim 1, wherein the controller controls the driver to rotate the drum upon selection of the water-soluble contaminant.

3. The fabric dryer of claim 2, wherein the drum rotates such that laundry tumbles in the drum.

4. The fabric dryer of claim 1, further comprising a hot air supply unit for supplying hot air into the drum, wherein upon selection of the water-soluble contaminant, the controller controls the hot air supply unit such that hot air is supplied after steam is supplied.

5. The fabric dryer of claim 1, wherein the controller controls the driving unit to rotate the drum upon selection of the fat-soluble contaminant.

6. The fabric dryer of claim 5, wherein the drum rotates such that laundry tumbles in the drum.

7. The fabric dryer of claim 4, further comprising a drying operation input unit operating the hot air supply unit to dry laundry in the drum upon selection, wherein the contamination removal function selector is provided separately from the drying operation input unit.

8. The fabric dryer of claim 1, further comprising an indicating lamp that is lighted according to selection of the water-soluble contaminant or the fat-soluble contaminant.

9. A method of controlling a fabric dryer, comprising:

selecting a water-soluble contaminant or a fat-soluble contaminant through a contamination removal function selector; and removing the contaminant from laundry in a drum according to the selected contaminant, wherein steam is supplied into the drum when the selected contaminant is water-soluble, and radical is supplied into the drum when the selected contaminant is fat-soluble.

10. The method of claim 9, wherein upon selection of the water-soluble contaminant, the drum rotates.

11. The method of claim 9, wherein the drum rotates such that laundry tumbles in the drum.

12. The method of claim 9, wherein upon selection of the water-soluble contaminant, hot air is further supplied into the drum after the steam is supplied.

13. The method of claim 9, further comprising processing laundry with a detergent before the steam is supplied upon selection of the water-soluble contaminant.

14. The method of claim 9, wherein upon selection of the fat-soluble contaminant, the drum rotates.

15. The method of claim 14, wherein the drum rotates such that laundry tumbles in the drum.

16. The method of claim 9, further comprising visually indicating that the water-soluble contaminant or the fat-soluble contaminant is selected.

* * * * *